United States Patent [19]

Osofsky et al.

[11] 4,055,104

[45] Oct. 25, 1977

[54] TIRE PIERCING MUNITION

[75] Inventors: Irving B. Osofsky, Rancho Palos Verdes; Hugh C. Thompson, Anaheim, both of Calif.

[73] Assignee: McDonnell Douglas Corporation, Long Beach, Calif.

[21] Appl. No.: 671,083

[22] Filed: Mar. 29, 1976

[51] Int. Cl.[2] ..... F42B 13/00

[52] U.S. Cl. ..... 89/1 A; 102/92.1; 102/92.4; 102/DIG. 7

[58] Field of Search ..... 102/91, 92.1, 92.4, 102/DIG. 7; 89/1 A; 244/3.23, 3.3

[56] References Cited

U.S. PATENT DOCUMENTS

| | | | |
|---|---|---|---|
| 1,464,192 | 8/1923 | Willson | 102/91 |
| 2,346,713 | 4/1944 | Walker | 89/1 A |
| 2,353,386 | 7/1944 | Bourcier | 89/1 A |
| 3,292,879 | 12/1966 | Chilowsky | 244/4.4 |

FOREIGN PATENT DOCUMENTS

| | | | |
|---|---|---|---|
| 784,754 | 5/1935 | France | 89/1 A |
| 861,452 | 10/1940 | France | 89/1 A |
| 1,539,955 | 8/1968 | France | 102/DIG. 7 |
| 683,550 | 10/1939 | Germany | 89/1 A |

*Primary Examiner*—Verlin R. Pendegrass
*Attorney, Agent, or Firm*—John P. Scholl; Walter J. Jason; Donald L. Royer

[57] ABSTRACT

A munition designed to be emplaced in concrete or other paved surfaces which is particularly destructive to pneumatic tires.

10 Claims, 7 Drawing Figures

TIRE PIERCING MUNITION

BACKGROUND OF THE PRESENT INVENTION

In combat situations it is desirable to deny an enemy the use of its roads, airfields and other paved areas which are utilized by pneumatic tired vehicles. In the past, the use of these areas has been restricted by bombing or by emplacing on such area mines, barricades, caltrops and similar devices. In most instances these devices have been of limited value because either the device was too large in size and therefore difficult to deliver and emplace or such device was too small and easily removed by sweeping or scraping by a bulldozer or similar vehicle.

SUMMARY OF THE PRESENT INVENTION

The subject invention is a munition which may be emplaced in large numbers to interdict airfields, roads and other paved surfaces. The munition is inexpensive, relatively small, easily delivered over a limited or large area and extremely difficult to remove. The munition is in two sections. The front section has a sharp, hard, high strength point designed to penetrate and embed itself in concrete and the like.

The rear section is constructed of a flexible spring member designed to protrude above the surface of the airfield or road and pierce, puncture, or otherwise damage pneumatic tires.

The munition may be emplaced by mechanical means similar to the method used to drive steel studs in concrete with an explosive charge. In the alternative, the munition may be provided with aerodynamic stabilization and air delivered similar to methods employed in the delivery of flechettes or darts.

To provide the munition with sufficient velocity to penetrate concrete or other hard surfaces, it may be dispensed from a high altitude by aircraft to free fall on the designated area or may be delivered at a lower altitude to a more limited area by a missile. An example of delivery of flechettes by missiles and the like is covered by U.S. Pat. No. 3,881,416. The munition as aforementioned embeds itself in the concrete or other paved surface and resists removal and destruction except by the most time and labor consuming means.

DETAILED DESCRIPTION OF THE PREFERRED EMBODIMENT

Figure 1:
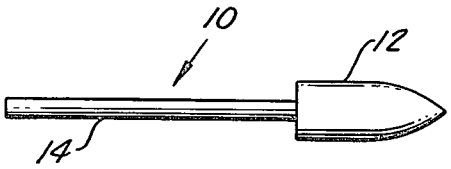
FIG. 1 shows a side view of one version of the two-sectioned munition of this invention.

In FIG. 1 a munition 10 is shown constructed in accordance with the present invention. The sharpened forward section 12 of the munition may be of steel, such as SAE 1062, whose hardness is Rockwell C 50'52. It has been found that good penetration will be obtained when the munition forward section is cylindrical and provided with a point which curves smoothly into the body such as a tangent ogive. The aft section 14 should be constructed of a material which is sufficiently strong to penetrate a pneumatic tire but has flexibility to withstand repeated bending without breaking or taking a permanent set. Such a material is piano wire or tempered steel.

Figure 2:
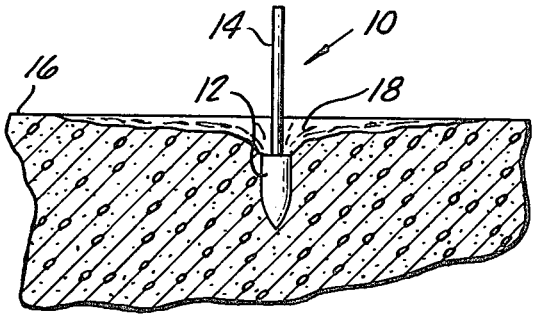
FIG. 2 is a side view of a munition of the type shown in FIG. 1 which has vertically penetrated concrete pavement.

In FIG. 2 the munition 10 of FIG. 1 has vertically penetrated a concrete surface 16. A spall area 18 of broken concrete surrounding the aft section is created by the penetration of the munition in the concrete. In tests utilizing a steel forward section with a diameter of 0.375 inch, the spall area was approximately 3 inches in diameter and varied in depth from approximately 0.5 inch adjacent to the munition to 0 inch at a distance of 1.5 inch from the munition. As indicated in FIG. 2, the concrete does not spall uniformly. The area of spall would also depend upon shape and size of the munition as well as the strength of the concrete of the road or runway which is being penetrated. New runway concrete may have an ultimate compressive strength of 3500 – 4000 psi while the strength of concrete in an aged surface (1 year old) will increase to 5000 psi or greater.

Removal of the munition is extremely difficult. It has been determined that a munition with a forward section of 0.250 inch diameter penetrated to a depth of 2.50 inches in concrete would require approximately 6000 pounds of tension force for removal.

Figure 3:
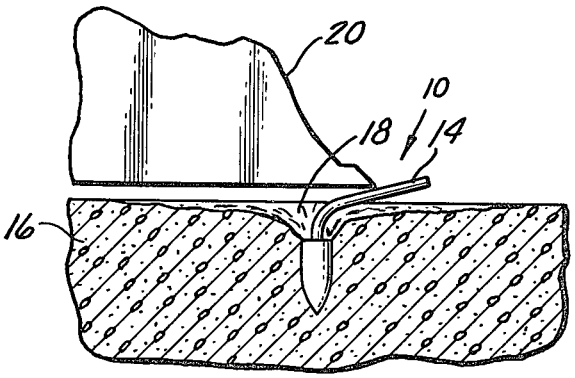
FIG. 3 is a side view of the munition of FIG. 2 with the aft section deflected from the vertical by a bulldozer blade.

An alternative approach to removal might be scraping or bending. In FIG. 3 a munition 10 of the inventive type is being scraped by a bulldozer blade 20 for removal from concrete pavement. The spall area 18 in the concrete surrounding the munition 10 permits the aft flexible section 14 of the munition to bend at a sufficiently large radius of curvature to allow full, or almost full, recovery of the aft flexible section 14 to the vertical after a sweep by a bulldozer blade in contact with the pavement surface.

If the aft section has a diameter of *d,* it has been found that if the radius of curvature of the aft section is limited to 3*d* or greater, the munition has good recovery to the vertical and maintains its tire piercing capability.

In simulated tests with munitions constructed with the aft section made of music wire of a diameter of 0.156 inch and less, the munitions survived twelve alternate direction sweeps with the flush end of a bulldozer blade. The effectiveness of the munition constructed with the flexible aft section can be appreciated when this test is compared with tests utilizing 0.25 inch diameter aft section of hardened steel. In this latter test the simulated munition was so badly bent or broken after the first pass of the bulldozer that it would have been ineffective to puncture pneumatic vehicle tires.

Figure 4:
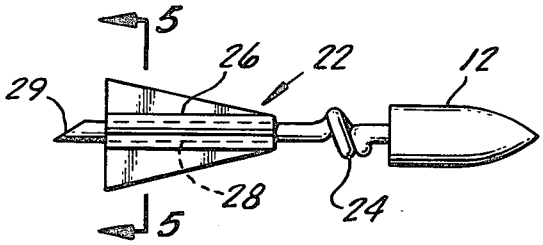
FIG. 4 is a side view of an alternative configuration of the munition wherein the aft section incorporates a flexible coil spring section to permit bending and spring-back recovery of the aft or rear section. The aft section of the munition is surrounded by a finned member.

FIG. 4 shows an alternative design of munition 22 wherein a coiled spring section 24 is incorporated in the aft section 28 to increase the flexibility of this section and its resistance to removal or damage by bending. This munition 22 should be designed so that the coil portion in the aft section is below the surface of the pavement when the munition is emplaced. If the coil section is below the paved surface it does not provide purchase for the removal of the munition by scraping.

The munition of FIG. 4 includes an aerodynamic stabilization element in the form of a fin assembly 26 encircling the aft section 28. The fin assembly 26 may take the form of a cylindrical member as shown in the enlarged (2 X) sectional view in FIG. 5. The fin assembly 26 may be constructed of plastic and is attached to the aft section 28 (FIG. 4) so that it disengages when the munition encounters a pneumatic tire or is bent by attempts to remove it from the paved surface. The aft section 28 may terminate in a sharpened point 29.

Figure 5:
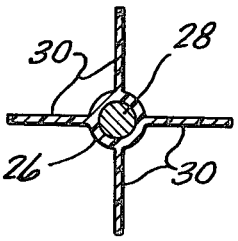
FIG. 5 is an enlarged sectional view through the munition and finned member of FIG. 4 along the section 5—5.

In FIG. 5 an enlarged sectional view of the four-finned cylindrical assembly 26 is depicted. This assembly 26 may be held in place on the aft section 28 by friction, adhesive or bonding. The section may have any number of fins 30 and its purpose is to stabilize the muniton in flight as it is delivered to the target.

Figure 6:
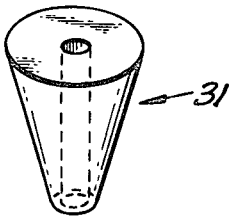
FIG. 6 is a perspective view of a flaired collar designed to surround the aft section and provide aerodynamic stability to the munition of FIG. 1.

An alternative configuration for the aerodynamic stabilization element could be a flare-shaped collar 31 which would encircle the aft tire piercing member (FIG. 6). The flare-shaped collar 31 may be held on the aft section of the munition of FIG. 1 by friction, adhesive, or bonding.

Figure 7:
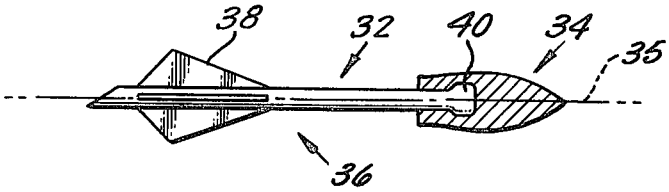
FIG. 7 is a side view of a second alternative configuration in which the rear section can rotate with respect to the forward section.

In FIG. 7 a second alternative embodiment 32 of the inventive munition is shown. This munition 32 is constructed so that the forward section 34 can rotate around the axes 35 with respect to the aft section 36. The aft section 36 has been provided with fins 38 which may be constructed integral with said section. Again the purpose of the fins is to stabilize the munition in flight. These fins are thin and may be of plastic or some frangible material such that they will break off when encountering a pneumatic tire or a bulldozer blade.

The aft section stabilization element should be designed so that it is removable and only the flexible shaft extends above the surface for penetration of a pneumatic tire. A larger surfaced element may resist penetration into the pneumatic tire. Further, if the section above the surface of the pavement is a smooth flexible shaft, it is extremely difficult for a bulldozer or other scraper to remove the munition.

In order to assemble the two sections of the munition 32 of FIG. 7, the forward end of the aft section is provided with an enlarged end 40 which enters the interior of the forward section 34. Once the two elements are in mating position the forward section is swedged to hold the two sections together and to permit them to rotate with respect to each other.

It has been found that the inventive munition will have greater resistance to removal by bending as a result of repeated passes in opposite directions by a scraper blade if the aft section can rotate with respect to the forward section when the munition is fixed in pavement.

In operation the munition may be emplaced in a paved surface by individual stud driving guns or by multiple guns mounted on a vehicle such as a truck. In the alternative the munition is air delivered to fall on and penetrate the paved surface. When the enemy attempts to move pneumatic wheeled vehicles such as cars, trucks or airplanes over the paved surface, the protruding aft section of the munition pierces the tires and effectively forecloses the use of the paved surface.

While certain exemplary embodiments of this invention have been described above and shown in the accompanying drawings, it is to be understood that such embodiments are merely illustrative of, and not restrictive on, the broad invention and that we do not desire to be limited in our invention to the specific constructions or arrangements shown and described, since various other obvious modifications may occur to persons having ordinary skill in the art.

What is claimed is:

1. A tire piercing munition for emplacement in concrete paving comprising:

a forward section having a sharp, hard, high strength point, said forward section of sufficient mass to be driven into and below the surface of said concrete paving when delivered with sufficient velocity or force, and an aft section attached to said forward section comprising a smooth flexible shaft adapted to protrude above said concrete paving when the forward section has been emplaced in said paving, said shaft having a stiffness and cross-section sufficient to penetrate a pneumatic tire.

2. The munition of claim 1 wherein said aft section includes a coiled spring portion to increase the flexibility of said aft section and increase its resistance to destruction by bending.

3. The munition of claim 1 wherein the aft section includes an easily removable aerodynamic means to stabilize the munition in flight.

4. The munition of claim 3 wherein said aerodynamic means includes fins attached to the aft section.

5. The munition of claim 3 wherein the stabilization means includes a flared collar surrounding and attached to said aft section.

6. The munition of claim 1 including rotatable attachment means connecting said aft section to said forward section whereby the aft section can rotate axially with respect to the forward section.

7. The munition of claim 1 wherein the aft section has a sharp point on the portion of said section protruding above the paved surface.

8. The munition of claim 1 wherein the forward section is in part cylindrical and has a sharp point constructed in the shape of a tangent ogive.

9. A tire piercing munition for emplacement in concrete paving comprising:

a relatively heavy cylindrical forward section with a sharp, hard, high strength point in the shape of a tangent ogive, said section having sufficient mass to be driven into and below the surface of said concrete paving when delivered with sufficient velocity or force, a relatively light aft section attached to said forward section, said aft section comprising a smooth flexible shaft adapted to protrude above the surface of said paving when the forward section is below the surface of the paving, said shaft having a length, stiffness and cross-section sufficient to penetrate pneumatic tires, and frangible fins attached to said shaft to aerodynamically stabilize the munition in flight.

10. A tire piercing munition for emplacement in concrete paving comprising:

a forward section with a sharp, hard, high strength point, said section of sufficient mass to be driven into and below the surface of said concrete paving when delivered with sufficient velocity or force, an aft section attached to said forward section comprising a smooth flexible shaft adapted to protrude above the surface of said paving when the forward section is below the surface of the paving, said shaft having a length stiffness and cross-section sufficient to penetrate pneumatic tires, and an easily removable flare attached to and surrounding said shaft to aerodynamically stabilize the munition in flight.

* * * * *